United States Patent [19]

Zipf

[11] 4,036,769

[45] July 19, 1977

[54] SPERM OIL SUBSTITUTE FROM BLEND OF ALCOHOL-CARBOXYLIC ACID ESTERS WITH LIQUID FAT

[75] Inventor: Robert L. Zipf, Parma Heights, Ohio

[73] Assignee: Werner G. Smith, Inc., Cleveland, Ohio

[21] Appl. No.: 131,531

[22] Filed: Apr. 5, 1971

[51] Int. Cl.[2] ..... C10M 1/38

[52] U.S. Cl. ..... 252/48.6; 252/56 S; 252/48.4; 252/49.8; 252/54.6; 252/33

[58] Field of Search ..... 252/56 S, 56 R, 48.6, 252/48.4, 33, 49.8, 54.6

[56] References Cited

U.S. PATENT DOCUMENTS

| | | | |
|---|---|---|---|
| 38,825 | 6/1863 | Hermance | 252/56 R |
| 1,477,635 | 12/1923 | Dodge | 252/56 R |
| 2,262,773 | 11/1941 | Lincoln et al. | 252/56 R |
| 2,757,139 | 7/1956 | Matuszak et al. | 252/56 S |
| 3,121,060 | 2/1964 | Duane | 252/56 S |

*Primary Examiner*—Daniel E. Wyman
*Assistant Examiner*—Mrs. Y. Harris-Smith
*Attorney, Agent, or Firm*—Bosworth, Sessions & McCoy

[57] ABSTRACT

A liquid lubricant comprising a blend from about 50 per cent to about 90 per cent by weight of an ester of a monohydric alcohol having from about 10 to about 18 carbon atoms and a monocarboxylic acid having 12 to 24 carbon atoms, and from about 10 per cent to about 50 per cent by weight of a fat liquid at room temperatures, such as fish oil. One or more of the monohydric alcohol, monocarboxylic acid, and liquid fat have sufficient carbon-to-carbon unsaturation to impart to the blend an iodine number up to about 140. The lubricant has a balance of properties adapting it to be used as a substitute for sperm oil, for example, a pour point below 50° F. and a S.U.S. viscosity at 100° F. within the range of about 60 to about 120. The blend may be used as such or chemically combined with sulfur, chlorine or other halogens, phosphorous, and the like.

9 Claims, No Drawings

SPERM OIL SUBSTITUTE FROM BLEND OF ALCOHOL-CARBOXYLIC ACID ESTERS WITH LIQUID FAT

BACKGROUND OF THE INVENTION

Sperm oil has long been used as an industrial lubricant, both in a natural state and in a sulfurized, sulfonated, or phosphated form. Sperm oil comprises a mixture of esters and glycerides and is a good lubricant by itself, such as for oiling light machinery, or for blending with other lubricants, such as mineral oil, to form compounded lubricants. Similarly, when chemically combined with sulfur, chlorine, phosphorous, and the like, sperm oil is popularly used either by itself as a lubricant or as an additive to other lubricants, particularly in cutting oils and for lubricating metal surfaces.

The Congress of the United States recently enacted the "Endangered Species Act of 1969" which prohibits importation of sperm oil and derivatives thereof after 1971. Consequently, not only is the supply of this valuable commodity presently diminishing, but after 1971 crude sperm oil will no longer be available for purchase. The cost of the presently available oil is also correspondingly increasing.

Due to the Endangered Species Act, the industry faces an increasing demand for a replacement for sperm oil. Preferably, the replacement should be one that is at least equal to or surpasses sperm oil in its adaptability for use as an industrial lubricant when used either alone or in combination with sulfur, chlorine, phosphorous, and the like.

It has been previously suggested to use alcohol esters of carboxylic acids as lubricant additives. Some of these could be sulfurized and used in place of sperm oil. In the past, liquid fats such as fish oils have also been sulfurized and used as a lubricant additive.

However, both of these additives have serious shortcomings. The alcohol-acid esters cannot be sulfurized to an extent desired. The liquid fats are triglycerides which are not sufficiently soluble in some of the blending oils to be readily useful.

SUMMARY OF THE INVENTION

A general object of the present invention is to provide a liquid lubricant which can be used in lieu of sperm oil. Another object is the provision of such a lubricant that can be used alone or in admixture with other lubricants. A further object is the provision of a lubricant which can be chemically combined with sulfur, halogens, phosphorous, and the like and either be employed by itself or as an additive to other lubricants, and in which amounts of these elemental additions of sulfur and the like can meet or exceed that possible with commercial sperm oil.

The lubricant of the present invention contains a minimum amount of glycerides and can be varied in its make-up so as to tailor it to meet certain demands of carbon-to-carbon unsaturation, a factor which is highly contributory to subsequent sulfonation and/or sulfurizing when the lubricant is to be so treated.

In one form, the present lubricant comprises a blend from about 50 percent to about 90 percent by weight of an ester of a monohydric alcohol having 10 to 18 carbon atoms and a monocarboxylic acid having 12 to 24 carbon atoms, such as a fatty acid, and from about 10 percent to about 50 percent by weight of a fat liquid at room temperatures, such as animal, vegetable, and fish oils. Each of the alcohol, acid, and liquid fat may be saturated or unsaturated to provide in the blend an iodine number from about 0 to about 140. Preferably some unsaturation is present if the blend is to be chemically combined with sulfur or the like. In this event, the blend should have an iodine number within the range of about 50 to about 140.

The blend should have a pour point below 50° F. and a S.U.S. viscosity at 100° F. within the range of about 60 to about 120 to provide other desired physical attributes. A small amount of free monocarboxylic organic acid may be present, for example, to impart to the blend an acid number less than 15. This has been found to reduce the coefficient of friction of the lubricant.

DESCRIPTION OF THE PREFERRED EMBODIMENTS

Considering initially the materials from which the blends are prepared, the monohydric alcohol has from 10 to 18 carbon atoms. Useful standard alcohols of this class include decyl alcohol, dodecyl alcohol, tetradecyl alcohol, stearyl alcohol, and cetyl alcohol. Although unsaturation, when present, is more likely to be found in the monocarboxylic acid reactant or in the liquid fat, it is within the contemplation of the present invention to use unsaturated alcohols in the preparation of the ester of the blends, such as oleyl alcohol. As indicated, the monohydric alcohol used in the present invention normally has an aliphatic chain which may be either saturated or unsaturated. However, the hydrocarbon chain of the alcohol may be straight, branched, or cyclic. Substituents can be present on the hydrocarbon chains of the alcohols as long as they do not alter the physical characteristics of the esters or blends outside of those values stated.

Oxo-acids, such as 2-ethyl hexoic acid and neodecanoic acid may be used, but the preferred monocarboxylic organic acids are the fatty acids. When carbon-to-carbon unsaturation in the blend is not necessary, saturated fatty acids can be used such as lauric, tridecoic, myristic, pentadecanoic, palmitic, margaric, stearic, nondecylic, arachidic, behenic, and carnaubic acids. However, normally some unsaturation is preferred to accommodate sulfurization at the unsaturated sites. Useful unsaturated fatty acids include hypogeic, oleic, ricinoleic, erucic, linoleic, palmitolic, stearolic, behenolic, arachidonic, and linolinic acids. Mixtures of different acids may be used, and the hydrocarbon chain of the acid may be straight, branched, or cyclic. Substituents can be present on the hydrocarbon chains of the acids as long as they do not alter the physical characteristics of the acids or the blends outside of those values stated. For example, hydroxylated acids may be used. A preferred source of the fatty acids, both saturated and unsaturated, is tall oil. Saturated fatty acids may be obtained from petroleum fractions.

Monohydroxy alcohols having more than 18 carbon atoms and monocarboxylic acids having more than 24 carbon atoms are unsuited for the present blends, because their use results in esters causing higher pour points in the blends than are satisfactory. Similarly, alcohols having less than 10 carbon atoms and acids having less than 12 carbon atoms are unsatisfactory, because the resulting esters impart flash and fire points that are too low for certain lubricant applications.

Oiliness has been defined as the power of a lubricant to maintain a film between two surfaces even when under heavy loads. Such oiliness is possessed by liquid fats to a greater extent than by lubricants like mineral oils. Accordingly, mixing the present alcohol-acid esters with a liquid fat results in better oiliness for the blend than that which results in mixing the esters with such lubricants as mineral oils.

Fats liquid at room temperatures (65° F. to 85° F.) and useful in the present invention include animal fats such as lanolin and lard oil; vegetable fats such as soybean oil, linseed oil, cottonseed oil, rape seed oil, tung oil safflower seed oil, coconut oil, poppy seed oil, walnut oil, olive oil, corn oil, peanut oil, sesame oil, palm oil, wheat germ oil, and the like; and fish oils such as cod, tuna, herring, alewife, sardine, pilchard, and menhaden. Fish oils are preferred because of the usual presence of some triunsaturation. The preferred fish oil is menhaden.

The blends may be prepared by reacting the monohydric alcohol and acid reactants, or mixtures of each principal reactant, under standard esterification conditions which are well known. The reaction may be carried out in a standard esterification kettle. Approximately one percent by weight of water is used based on the weight of the carboxylic acid. The presence of water reduces the initial esterification temperature. No catalyst is needed. The kettle is heated up to about 500° F., for example. Provision may be made for reflux of the alcohol. A steam heated reflux may be used to insure that water formed by the esterification process is vented. Any excess unreacted alcohol present at the end of the esterification can be stripped from the batch by vacuum.

Esterification is continued until the acid number is reduced to a desired figure. In the present blend, the presence of some free carboxylic acid has been found desirable. Free fatty acids, for example, decrease the coefficient of friction of the blend as compared to a neutral lubricant. However, the acid number should not exceed about 15, or the blend becomes too acidic.

Fish oils may be prepared by any known standard technique, for example, by cold pressing which is preferred since an oil is obtained that is lower in pour point than by most other techniques. Chopped fish may also be heated in water for a time to cause an oil to separate and float to the top from where the oil can be collected and concentrated.

Following preparation of the described esters, the liquid fat is incorporated by simple mixing and stirring. The blend may be heated slightly if desired to facilitate homogenation. The blend comprises from about 50 percent to about 90 percent by weight of the ester or esters and from about 10 percent to about 50 percent by weight of the liquid fat.

When the blend contains little or no unsaturation such that the iodine number is approximately zero, the blend still has an oily or fatty feel and may be used in drawing compounds, textile lubricants, emulsifiers, metal working compounds, and in high temperature metal forming operations. Normally, some unsaturation is desired to provide sites for chemical combination with other materials, such as free sulfur, although an unsaturated blend without sulfurization still has lubricity and can be used in metal working compounds.

When unsaturation is desired, it may be realized from the esters (either or both of the alcohol and acid components of the esters) or from the liquid fat. The unsaturation may be sufficiently high to impart an iodine number up to about 140 to the blend. Upon sulfurization, such unsaturation enables relatively large amounts of sulfur or the like to be chemically added to the esters. In the preferred embodiment, the iodine number should not fall below 50 when subsequent addition of other elements is to be made. Below this iodine number, the pour point of the blend becomes undesirably high, and there are not sufficient unsaturated sites for sulfurization and the like.

The pour point of the blend must be below about 50° F., so that it remains in the liquid state under general conditions of use. The blend itself can serve as a pour point depressant. Similarly, the blend has a viscosity befitting it for general application when it has a S.U.S. viscosity at 100° F. within the range of about 60 to about 120.

Although preparation of the esters has been described as by standard esterification between an alcohol and an acid, it is to be understood that it is immaterial how the esters are, in fact, formed. For example, the methyl esters of the described monocarboxylic acids can be used to react with the alcohols. In this case, the described alcohol-acid esters are still obtained but methyl alcohol is released instead of water otherwise formed by esterification. Still further, the esters may be prepared by transesterification.

It has long been known that sulfur, the halogens notably chlorine, and phosphorous can be added to lubricating oils to enhance their lubricating properties. The exact manner in which these elements or radicals containing them act to produce the improved results is not clearly understood. The techniques for adding such elements as sulfur, chlorine, and phosphorous to lubricants are well known in the art. However, to illustrate the adaptability and flexibility of the present blend, the addition of sulfur is described in detail.

In general, the more sulfur that can be chemically attached to the molecules comprising the lubricant, the better for lubricating purposes, especially the cutting of metals. There are three different types of sulfur-additions to a lubricant which may be defined as follows:

Sulfurizing (or sulfuretting)

The addition of elemental sulfur to an unsaturated or saturated organic hydrocarbon chain. In the case of an unsaturated site, an atom of sulfur adds to the double bond, thereby satisfying the bond without the release of any by-product but with a reduction in the iodine value since the unsaturated site becomes saturated. With a saturated hydrocarbon chain, two hydrogen atoms are removed and escape with an atom of sulfur as hydrogen sulfide, while another atom of sulfur satisfies the bonds previously satisfied by the two hydrogen atoms.

Sulfation

The reaction of such sulfur-containing materials as sulfur trioxide, chlorosulfuric acid, and sulfuric acid to hydroxyl groups. The product is called a sulfate. Sulfation of the present blend is possible if hydroxy carboxylic acids are used or if hydroxyl radicals are present in the liquid fats.

Sulfonation

The reaction of such sulfur-containing materials as sulfur trioxide, chlorosulfuric acid, or sulfuric acid with carbon-to-carbon unsaturated sites in hydrocarbon chains and with carboxyl groups. The product is called a sulfonate.

Each type of addition has its advantages. Sulfurizing is employed when the lubricant is to be subjected to extreme pressures such as, for example, a lubricant for hypoid gears. Sulfation is used when a surface-active, wetting lubricant is desired, since sulfates reduce the surface tension of a lubricant. Sulfonation similarly imparts surface-active properties to lubricants which are not obtainable with either sulfurizing or sulfation.

In the present blends, sulfur performs an additional unique function in that it serves as a bridge between at least some of the alcohol-acid esters and some of the liquid fat. That is, the same sulfur atom reacts with unsaturated sites on both an ester molecule and a liquid fat molecule to connect the two chemically. To the extent that this occurs, there is not a mere mixing or blending of the alcohol-acid esters and the liquid fat.

The wider adaptability of the present blends resides in the fact that both sulfurizing and sulfonation can easily be made to add sulfur and, if hydroxyl groups are present, sulfation as well can be carried out. When a hydrocarbon chain of the ester, originating from either the alcohol or acid, is saturated or unsaturated, it can be sulfurized. And the unsaturated hydrocarbon chains can be sulfonated. This ability of the blend to be reacted chemically with sulfur and the like provides the desired sperm oil-like characteristics.

To add sulfur, the blend is mixed with the requisite amount of a sulfur-containing compound and heated in a closed vessel with agitation. Uniform heating by means of a surrounding heat-transferring medium is desirable to avoid scorching as the viscosity of the mass increases. Alternatively, the sulfur can be added periodically or continuously as the reaction proceeds but in a manner to increase the temperature gradually. Up to about 20 parts of the sulfur-containing compound are used per 100 parts of the blend, although these relative amounts are not critical.

In addition to those materials previously noted, such sulfur-containing compounds may be used as sulfur monochloride, sulfur dichloride, phosphorous trisulfide, and phosphorous pentasulfide. The reaction temperature may vary from as low as 150° F. to as high as 500° F. or higher, depending principally on the sulfur-containing compound used. For example, sulfur monochloride is used at the lower temperatures of the range indicated, while elemental sulfur is used at temperatures at the higher end of the range such as about 350° F. The reaction is continued until a sufficient amount or a maximum amount of sulfur possible has been chemically combined. The course of the reaction may be followed by withdrawing test samples and determining the change in viscosity. The end viscosity of the sulfurized blend should preferably be within the range of about 200 to about 300, S.U.S. viscosity at 210° F. The present blend can contain as little as one percent by weight of sulfur to as much as 18 percent. After the reaction has been completed, the blend is cooled to room temperature when it can be stored in suitable containers.

To add chlorine, free chlorine gas can be bubbled through the blend at room temperature for a time sufficient to add chlorine chemically to a desired extent up to the maximum possible. Phosphorous trichloride or phosphorous pentachloride can be used similarly admixed with the blend, usually at room temperature, to add phosphorous or phosphorous-containing groups. These techniques are well known in the art. Reference is also made to U.S. Pat. No. 3,068,218 to Beretvas et al which discloses sulfochlorination of hydrocarbons, such patent being hereby incorporated by reference.

The following examples are intended to illustrate the invention and should not be construed as limiting the claims. Percentages are by weight.

EXAMPLE 1

Tall oil purchased from Arizona Chemical Company under the trademark "Acintol" had this analysis:

| Component or Property | Percentage or Value |
|---|---|
| Color, Gardner | 1– |
| Acid Number | 198 |
| Saponification Value | 200 |
| Iodine Number | 130 |
| Composition: | |
| Moisture, % | <0.1 |
| Ash, % | <0.001 |
| Rosin Acids, % | 0.5 |
| Unsaponifiables, % | 0.5 |
| Fatty Acids Total, % | 99.0 |
| Fatty Acid Composition: | |
| Linoleic, Non-Conjugated, % | 38 |
| Linoleic, Conjugated, % | 5 |
| Oleic, % | 49 |
| Stearic Acid, % | 2 |
| Other Fatty Acids, % | 6 |
| Specific Gravity, 25° /25° C | 0.897 |
| Weight Per Gallon, 25° C, Lbs. | 7.45 |
| Viscosity, Gardner-Holdt, 25° C | A |
| Viscosity, SUS, 100° F | 93 |
| Flash Point, Open Cup, ° F | 400 |
| Fire Point, Open Cup, ° F | 435 |

A mixture of alkyl alcohols was purchased from Continental Oil Company under the trademark "Alfol 1214". The mixture consisted of 54 percent of $C_{12}$ alcohols and 45 percent of $C_{14}$ alcohols and had this analysis:

| Component or Property | Percentage or Value |
|---|---|
| Color APHA (Hazen) | 5 |
| Water (%) | 0.05 |
| Hydroxyl Number | 279 |
| Melting Pt. (° C) | +14 |
| Sp. Gr. (60/60° F) | 0.838 |
| Iodine Number | 0.2 |
| Saponification Number | 0.2 |
| Acidity (%, as HOAc) | 0.01 |
| Boiling Range ° C (ASTM-D1078)IBP | 270 |

A cook was prepared in a kettle comprising 7784 grams of the tall oil fatty acid material, Acintol, 5734 grams of Alfol 1214, and 22 grams of concentrated sulfuric acid. A blanket of carbon dioxide gas was continuously played over the contents in the kettle while it was heated to raise the temperature of the contents gradually to about 400° F. in 5 hours and 45 minutes. A reflux condenser was used to prevent excessive loss of alcohol.

A blend was then prepared consisting of 1600 grams of the result of the cook and 800 grams of light, cold pressed menhaden fish oil. The resulting blend had this analysis:

| Property | Percentage or Value |
|---|---|
| Acid Number | 5.34 |
| Saponification Number | 140.2 |
| Iodine Number | 103.0 |
| SUS at 100° F. | 85.3 |
| SUS at 210° F. | 41.0 |
| Color Gardner | 6–7 |
| Cloud Point, ASTM | 48° F. |
| Pour Point, ASTM | <20° F. |
| Flash, Cleveland Open Cup | 390° F. |
| Fire, Cleveland Open Cup | 495° F. |

EXAMPLE 2

The blend produced in accordance with Example 1 was sulfurized by heating 1000 grams of the blend slowly to 300° F. and then adding 160 grams of elemental sulfur slowly over about a two hour period at a rate to keep the temperature of the mixture below 350° F. After all the sulfur had been added, the batch was held at 335° F. for 6 hours. The cook was then allowed to cool to a temperature within the range of about 240° to 260° F. when air was blown through the cook for 1 hour to remove free hydrogen sulfide. The product produced contained 15 percent sulfur by weight.

In place of tall oil, separate pure or relatively pure fatty acids may be used having from 10 to 24 carbon atoms. Mixtures of the pure acids can also be fabricated to meet diverse requirements, especially as to the amount of carbon-to-carbon unsaturation. Similarly, in place of the $C_{12}$ and $C_{14}$ alcohols of "Alfol 1214", other monohydric alcohols having from 10 to 18 carbon atoms could have been used.

The present blends may be used as such or with additions of elements like sulfur, the halogens, or phosphorous, or groups containing these elements. The blends may be sulfurized and/or sulfonated. When hydroxyl groups are present, the blends may also be sulfated. In any case, the blends may be used as a lubricant by themselves or incorporated with still other lubricants such as mineral oil. The blends can if desired be refined, bleached, and/or stripped by steam deodorization.

Although the foregoing describes several embodiments of the present invention, it is to be understood that the invention may be practiced in still other forms within the scope of the following claims.

I claim

1. A liquid lubricant comprising a blend consisting essentially of:

a. from about 50 percent to about 90 percent by weight of synthetic esters of monohydric alcohols each having 10 to 18 carbon atoms and fatty acids each having 12 to 24 carbon atoms, at least one of said esters containing carbon-to-carbon unsaturation, and b. from about 10 percent to about 50 percent by weight of a fat liquid at room temperature and selected from the class consisting of animal oils, vegetable oils, fish oils and mixtures thereof, and c. free fatty acids each having 12 to 24 carbon atoms and being present in an amount such that the acid number of the blend is less than 15 but at least about 5, said blend having an iodine number from about 50 to about 140, a pour point below 50° F. and a S.U.S. viscosity at 100° F. within the range of about 60 to about 120.

2. The lubricant of claim 1 in which said liquid fat is a fish oil selected from the group consisting of cod, tuna, herring, alewife, sardine, pilchard, and menhaden.

3. The lubricant of claim 1 in which said liquid fat is menhaden fish oil.

4. The sulfurized lubricant of claim 1.

5. The sulfurized lubricant of claim 1 containing from about 1 percent to about 18 percent sulfur by weight.

6. The sulfo-chlorinated lubricant of claim 1.

7. The chlorinated blend of claim 1.

8. The phosphated blend of claim 1.

9. The sulfurized lubricant of claim 1 in which sulfur chemically bridges at least some of said ester with some of said liquid fat.

* * * * *